US009131731B2

(12) United States Patent
Chojnacki et al.

(10) Patent No.: US 9,131,731 B2
(45) Date of Patent: Sep. 15, 2015

(54) METHOD AND APPARATUS FOR DESTRUCTIVE OPENING CIGARETTE PACKS

(75) Inventors: Wojciech Jerzy Chojnacki, Radom (PL); Wojciech Janczyk, Kowala (PL)

(73) Assignee: INTERNATIONAL TOBACCO MACHINERY POLAND SP. Z.O.O., Radom (PL)

( * ) Notice: Subject to any disclaimer, the term of this patent is extended or adjusted under 35 U.S.C. 154(b) by 1106 days.

(21) Appl. No.: 13/067,888

(22) Filed: Jul. 5, 2011

(65) Prior Publication Data

US 2012/0000167 A1 Jan. 5, 2012

(30) Foreign Application Priority Data

Jul. 5, 2010 (PL) ..... 391718

(51) Int. Cl.
*A24C 5/36* (2006.01)
*B65B 69/00* (2006.01)

(52) U.S. Cl.
CPC ..... *A24C 5/36* (2013.01); *B65B 69/0033* (2013.01)

(58) Field of Classification Search
CPC ..... B65B 69/0033; B65B 69/00
USPC ..... 131/96; 414/412; 53/381.1
See application file for complete search history.

(56) References Cited

U.S. PATENT DOCUMENTS

| | | | | | |
|---|---|---|---|---|---|
| 3,889,442 | A * | 6/1975 | Grahn et al. | ..... | 53/492 |
| 3,991,892 | A * | 11/1976 | Rowland, Jr. | ..... | 414/811 |
| 4,034,868 | A * | 7/1977 | Rowland, Jr. | ..... | 53/381.1 |
| 4,036,380 | A * | 7/1977 | Berry et al. | ..... | 414/412 |
| 4,696,615 | A * | 9/1987 | Ettischer et al. | ..... | 414/795.8 |
| 5,048,267 | A * | 9/1991 | Kudo et al. | ..... | 53/492 |
| 5,275,523 | A * | 1/1994 | Stewart et al. | ..... | 414/412 |
| 5,737,842 | A | 4/1998 | Freedman | | |
| 6,189,298 | B1 * | 2/2001 | Kuji et al. | ..... | 53/492 |
| 7,578,297 | B2 * | 8/2009 | Villarinho | ..... | 131/281 |
| 2008/0104933 | A1 * | 5/2008 | Flagg | ..... | 53/493 |

FOREIGN PATENT DOCUMENTS

| | | | |
|---|---|---|---|
| CN | 1644116 | A | 7/2005 |
| CN | 101104448 | A | 1/2008 |
| CN | 102018282 | A | 4/2011 |
| DE | 90 12 972 | U | 11/1990 |
| DE | 195 05 260 | A1 | 8/1996 |
| EP | 0447208 | A2 | 9/1991 |

(Continued)

OTHER PUBLICATIONS

European Search Report with Abstract, EP Application No. 11172620 4-2313, dated Oct. 5, 2011, 5 pgs.

(Continued)

*Primary Examiner* — Andrew M Tecco

(74) *Attorney, Agent, or Firm* — Nixon & Vanderhye P.C.

(57) ABSTRACT

A method of destructive opening cigarette packs in which the packs are successively mechanically deformed by deflection of at least one wall of each pack toward the outside of the pack, then the deflected wall of the pack is incised from the outside and a pack opening element is slid between the deflected wall of the pack and the cigarettes contained therein, and the pack is opened from the inside by means of the pack opening element.

An apparatus for destructive opening cigarette packs using the method according to the invention.

11 Claims, 4 Drawing Sheets

(56) References Cited

FOREIGN PATENT DOCUMENTS

| | | | |
|---|---|---|---|
| EP | 0 534 623 | A1 | 3/1993 |
| EP | 0534623 | A1 | 3/1993 |
| EP | 1 619 968 | B1 | 2/2006 |
| JP | 2085121 | A | 9/1990 |
| JP | H07155482 | A | 6/1995 |
| JP | 11043122 | A | 2/1999 |
| JP | 2001259256 | A | 9/2001 |
| JP | 3092302 | U | 3/2003 |
| JP | 4089848 | B2 | 5/2008 |
| RU | 2 304 418 | C2 | 8/2007 |
| WO | WO9703883 | A1 | 2/1997 |
| WO | WO 2008/131504 | A1 | 11/2008 |
| WO | WO2008131504 | A1 | 11/2008 |

OTHER PUBLICATIONS

Polish Patent Office Search Report; Polish Patent Application No. P-391718, dated Jul. 5, 2010 (2 pgs).

Chinese Search Report issued in Chinese Patent Application No. 2011101936299, (1 pg.) dated Jul. 5, 2011.

* cited by examiner

METHOD AND APPARATUS FOR DESTRUCTIVE OPENING CIGARETTE PACKS

The present invention concerns a method and an apparatus for destructive opening cigarette packs in order to reclaim the tobacco contained in cigarettes. Machines of this type are used in the tobacco industry for processing low quality cigarettes or the cigarettes that have been damaged during production.

BACKGROUND OF THE INVENTION

A known apparatus for opening cigarette packs is described in the document U.S. Pat. No. 4,036,380. In this apparatus the packs are cut on both sides and the cigarettes are blown out by an air jet directed in parallel to the cigarettes.

Document DE 28 40 999 describes a device in which packs are first cut on both sides and then turned over on a double-belt conveyor, after which the cigarettes fall out of the packs by the force of gravity.

Document EP 0 481 191 discloses a device in which packs are first cut on both sides in order to remove, among others, the cigarette filters, and then the packs are deformed by squeezing its side walls so as to loosen the shortened cigarettes (the tobacco parts of the cigarettes) and spill them out.

Finally, a device is known from the document U.S. Pat. No. 5,086,790 in which a soft pack is punctured by means of tubular needles through which pressurized air is injected into the inside the pack; upon "pumping up" the pack, its bottom side is cut off and the cigarettes contained therein are pushed out by means of a push rod.

In the above described machines the packs are opened by means of cutting, optionally involving puncturing as in case of U.S. Pat. No. 5,086,790. However, the cutting performed by means of disc knives, straight cutting edge knives, saws, water or laser cutting, results in the cigarettes being incised as well. Consequently, none of the known machines enables recovery of the cigarettes in an undamaged condition. A mixture of open cigarette packs, cigarettes and the cigarettes accidentally damaged during the opening of the packs is obtained. The incision of the cigarettes causes unnecessary degradation of the tobacco contained inside; further a dust is formed during the opening which is mixed with the tobacco. The dust may consist of harmless paper dust as well as of cellophane foil dust which is very detrimental to health.

SUMMARY OF THE INVENTION

The method according to the present invention relates to destructive opening cigarette packs in which the packs are successively mechanically deformed by deflection of at least one wall of each pack toward the outside of the pack, then the deflected wall of the pack is incised from the outside and a pack opening element is slid between the deflected wall of the pack and the cigarettes contained therein, and the pack is opened from the inside by means of the pack opening element.

Preferably the packs are deformed by swelling, the swelling may in particular be realized by moving slidable holding means towards the pack or by negative pressure.

The packs may be opened by cutting a wall of the pack or by tearing a wall of the pack, preferably along the whole length of the wall up to the connection with the pack bottom.

The pack opening element may be moved in relation to a stationary pack or the pack may be moved in relation to a stationary pack opening element.

According to the invention an apparatus for destructive opening cigarette packs is provided, equipped with means for moving the packs in the apparatus, means for deforming successive packs by deflection of at least one wall of each pack toward the outside of the pack, and means for incising at least one of the walls of the pack from the outside, the apparatus being provided with at least one pack opening element for opening successive packs from the inside, the pack opening element being adapted for sliding it through the outside incision between the deflected wall of the pack and the cigarettes contained therein.

The pack opening element that is slid through the outside incision preferably has a part consisting of a contact surface that is substantially parallel to the pack wall being cut, the element also comprising a blade having beveled edge adapted for breaking the connection of the wall being cut with the bottom of the wall.

Preferably, the element for opening the pack from the inside comprises at least one cutting blade located on its side opposite to the contact surface.

The pack opening element may have cutting edges adapted for cutting the corners of the pack.

Preferably, the means for incising from the outside consist of at least one disc knife.

Preferably, the apparatus is further provided with at least one additional disc knife cooperating from the outside of the pack with the pack opening element.

In a variant, the apparatus may be provided with means for incising from the outside both front walls of a pack, each of the walls being incised along one edge, and with two pack opening elements, each located adjacent to one of the opposing front walls of at least one pack.

The means for deforming the packs preferably comprise negative pressure means or holding means preferably driven by actuators, preferably consisting of rotary holding elements.

In the apparatus according to the invention the at least one pack opening element is mounted in such a way that it may be translated transversely in relation to the direction of the incision made from the outside.

Preferably, the at least one pack opening element is mounted in such a way that it may be rotated about an axis perpendicular to the direction of the outside incision.

The means for moving the packs in the apparatus may consist of a pusher moving the packs in the direction towards the pack opening element.

Optionally, the apparatus is provided with means for moving the packs in the direction parallel to the line of the incision made from the outside.

Advantageous Features of the Invention

According to the invention an apparatus has been designed for destructive opening of the cigarette packs in a way enabling easy removal of the cigarettes in an undamaged condition i.e. without degradation of the tobacco and without incising of the cigarette paper wrappers and therefore without incurring the risk of introducing into the tobacco the impurities resulting from the cutting.

During the opening of the pack, one of its walls is incised or torn, and the connection of this wall with the bottom of the pack is also broken in such a way that the forces generated during this destructive opening do not affect the cigarettes. Hence, upon the opening of the pack, the cigarettes keep their arrangement as inside the pack. In the case of hard packs, after the pack has been destructively opened, the cigarettes remain wrapped only in the aluminum foil in which they have been packed prior to being located in the pack during production. Slight squeezing of the cigarettes wrapped in the foil perpendicularly to their axes will suffice to take them out from the foil in an undamaged condition.

The present invention relates to the opening of cigarette packs in the form of hard boxes having a flip-up top of any shape and with any type of a hinge, as well as to the soft cigarette packs. For the sake of simplicity, the following three definitions relating to the pack walls will be used in the present description: bottom—the non-openable smallest wall, the surface of which is perpendicular to the cigarette axes, side wall—the wall parallel to the cigarette axes which is the smaller one of the two walls parallel to the cigarette axes, front wall—the wall parallel to the cigarette axes which is the bigger one of the two.

BRIEF DESCRIPTION OF THE DRAWINGS

The object of the invention in exemplary embodiments is presented in the drawing, in which.

DETAILED DESCRIPTION OF PREFERRED EMBODIMENTS

Figure 1:
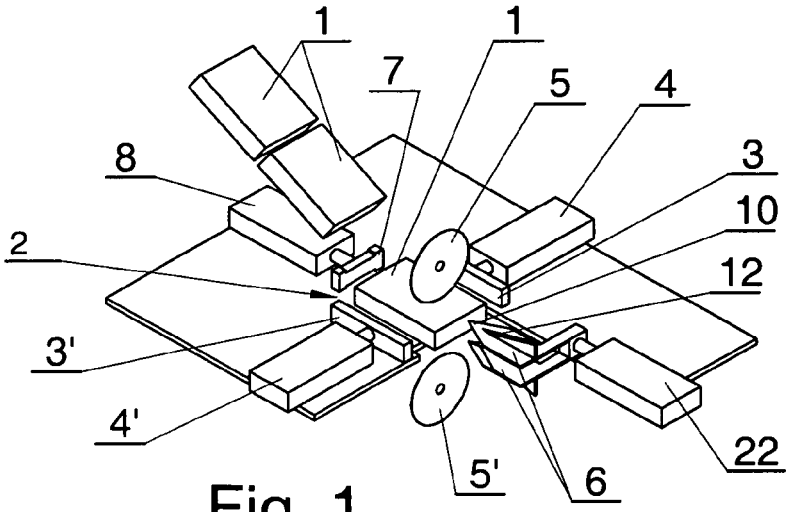
FIGS. 1-3 show perspective views of successive stages of operation of the apparatus according to the invention in the first embodiment.
Figure 4:
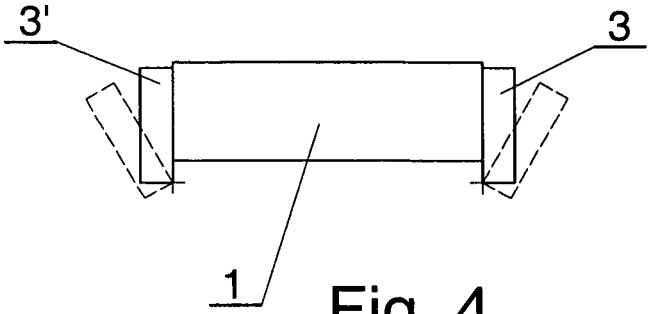
FIG. 4 shows a cigarette pack seen from its bottom side with the rotary means for deforming the pack.

FIG. 1 shows the first embodiment of the apparatus according to the invention for destructive opening of packs 1, provided with a seat 2 in which the pack 1 is located to be opened. On both sides of the pack 1 holding elements 3, 3' are located that are designed to catch the pack 1 and to hold it in swollen condition during incision and opening. The holding elements 3, 3' are moved by means of actuators 4, 4' and are adapted to be moved in perpendicular to the side walls of the pack 1 located in the seat 2. The holding elements 3, 3' may also be rotated (being driven by means of rotary actuators) about an axis which is parallel to the side walls of the pack 1 as shown in FIG. 4 where the holding elements 3, 3' in a position away from the pack 1 are indicated by a dotted line. In both cases electric drive e.g. electromagnet drive may be used. In FIG. 1 the holding elements 3, 3' are shown in a position away from the pack 1. Incision of the pack 1 may be performed by means of e.g. rotating knives 5, 5' which are driven adjacent to the pack 1 and then sunk into the pack to such a depth that the cigarettes are not damaged, the knife 5 being located above the pack 1 while the knife 5' is located below the pack 1. In FIG. 1 the knives 5, 5' are shown in a position away from the pack 1. The knives 5, 5' may be moved in a direction substantially perpendicular to the incised surface and after they have been sunk into this surface (FIG. 2) they perform the incisions 9 by being translated in parallel to the incised surface and in perpendicular to the axes of the knives 5, 5'. The guides necessary for the linear movements of the knives 5, 5' and the rotary drives have been omitted in the drawing for the sake of simplicity. The knives 5, 5' are arranged in such a way that the incision 9 is made at the distance of 5-10 mm from the edge connecting the bottom of the pack 1 with its front wall.

Figure 2:
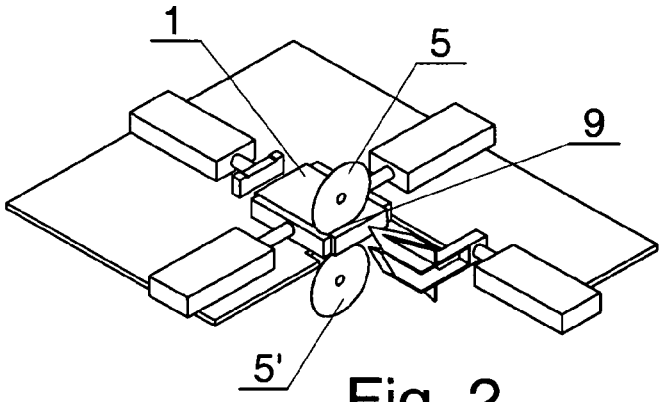
Figure 3:
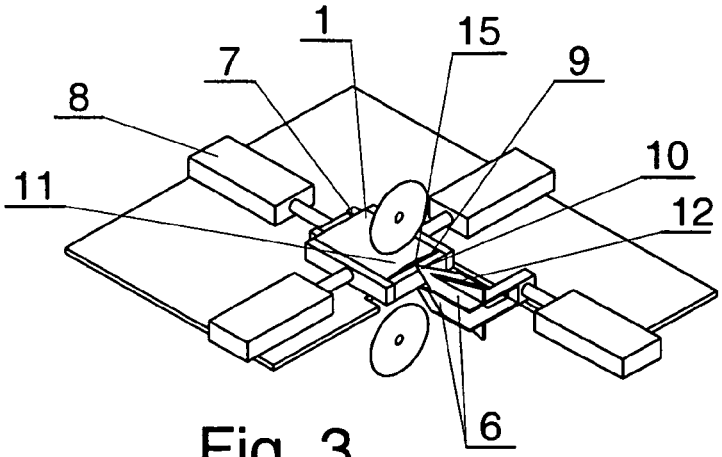
Figure 5:
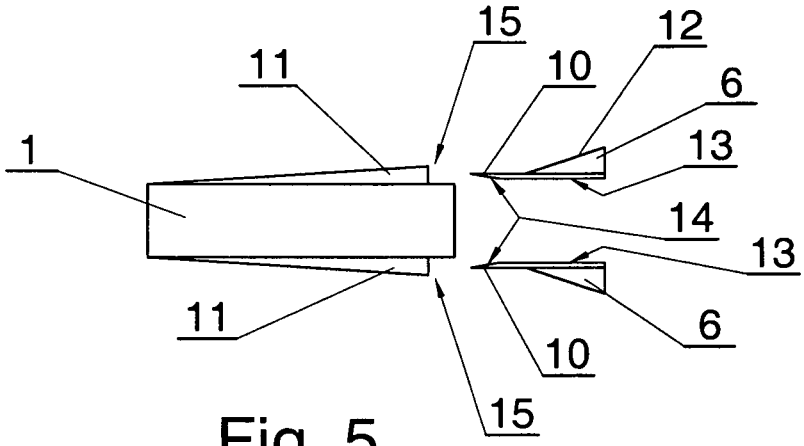
FIG. 5 shows side view of a cigarette pack and the opening elements after the incision from the outside have been performed and before sliding the opening elements inside the pack.
Figure 6:
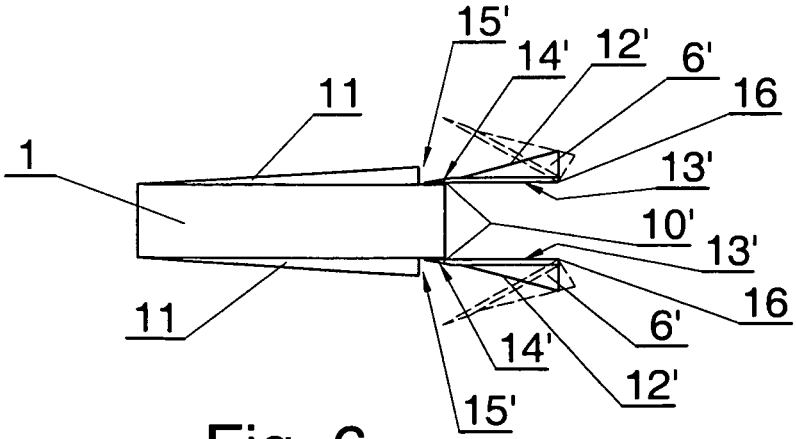
FIG. 6 shows a view similar to that of FIG. 5 but with rotary opening elements.
Figure 7:
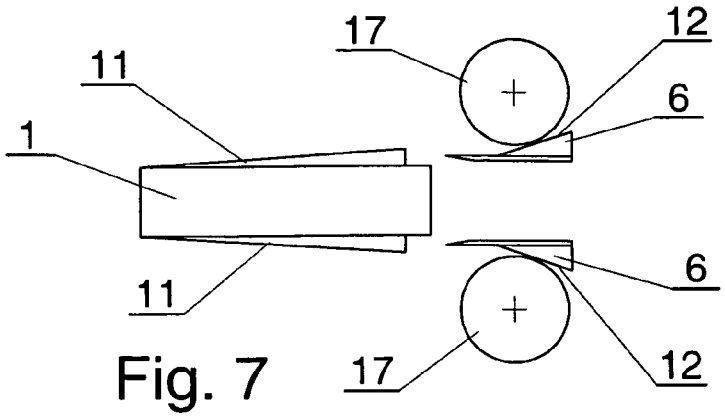
FIGS. 7 and 8 show side views of two variants of opening elements cooperating with additional disc knives.
Figure 8:
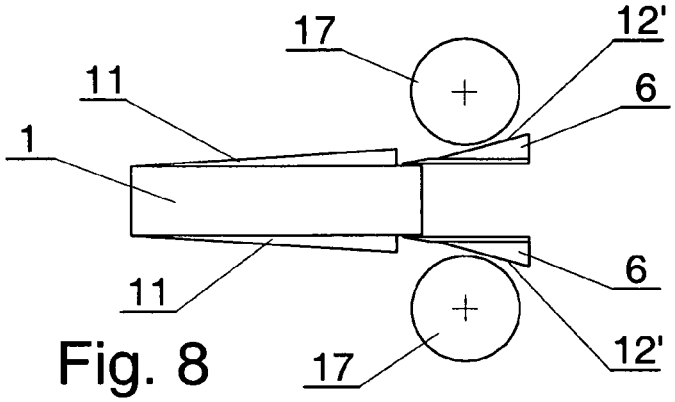
Figure 9:
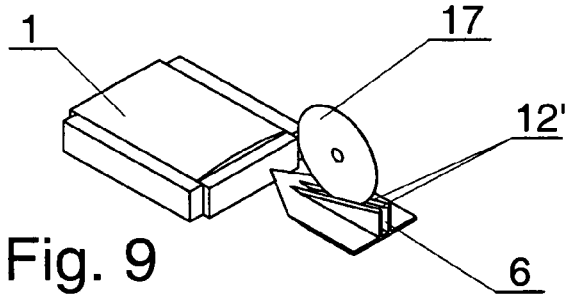
FIG. 9 shows a perspective view of another variant of the opening element cooperating with a disc knife.

The apparatus for destructive opening of packs 1 is provided with at least one opening element 6 located on the side of the pack where the incision is made. The opening element 6 may be realized as a stationary element or it may be mounted on an actuator 22. On the other side of the pack a pusher 7 is arranged, which is designed to perform translation movement causing the opening of the pack 1. The pusher 7, driven by the actuator 8, is aimed at translating the pack 1 towards the opening element 6, due to which the opening element 6 is slid inside the pack 1 through the already made incision 9. The opening element 6 may consist of e.g. a non-planar knife and the apparatus for opening the packs 1 may be provided with two opening elements 6 as shown in FIG. 1. The opening element 6 shown in FIGS. 1-3 is equipped with a blade 10 the function of which is to be slid under the deflected surface 11 of the pack 1 through the incision 9. The opening element 6 has a part consisting of a contact surface 13 (shown in FIG. 5) that is substantially parallel to the pack wall being cut, the function of this part is to support the cigarettes while cutting the pack 1. The opening element 6 also has a cutting blade 12 designed to cut the deflected surface 11 of the pack 1. FIG. 5 shows the location of the opening element 6 in relation to the deflected surface 11 of the pack 1 and the resulting gap 15. As may be seen in FIG. 5, the blade 10 has a beveled edge 14 on the side of the pack 1 in order to facilitate the movement of the opening element 6 against the edge of the pack 1 connecting the front wall with the bottom of the pack. In an alternative embodiment of the opening element 6' (FIG. 6) the blade 10' may have a beveled edge 14' on the side opposed to the opened pack 1 which is useful in the case of the packs that are difficult to be deformed and to have the surface 11 lifted so that a gap 15' is formed by the incision 9 which is big enough for easy introduction of the opening element 6'. The opening element 6' in the embodiment shown in FIG. 6 consists of a rotary element having a rotation axis 16. After the opening element 6' has been rotated to the opening position, it abuts by its contact surface 13' to the part of the front wall in front of the gap 15', which facilitates the introduction of the blade 10' under the surface 11 through the gap 15'. Depending on the type of the material of the pack 1, elements aiding the opening may be used. FIG. 7 shows an opening element 6 cooperating with a disc knife 17 that may be located adjacent to the cutting blade 12 in order to aid the cutting of the wall of the pack 1. Similarly, FIG. 8 shows an opening element 6 cooperating with a disc knife 17 that may be located adjacent to the cutting blade 12' in order to aid the cutting of the wall of the pack 1. An opening element 6 equipped with two cutting blades 12' may also be used, the two blades 12' being situated in parallel to each other and embracing the cutting edge of the knife 17 which is introduced in between the two blades 12' (FIG. 9).

The pack 1 from which the cigarettes are to be removed is introduced from above in the seat 2 (FIG. 1). Then the activated actuators 4, 4' move the holding elements 3, 3' towards the pack 1 into a position enabling it to be caught and deformed (FIG. 2). After the pack 1 has been swollen, the rotating knives 5, 5' are driven towards the front wall of the pack 1 (FIG. 2). Driving the knife 5 adjacent to the upper front wall, and the knife 5' to the lower front wall and their sinking into these walls causes the process of incision to start. Then the knives move in the direction parallel to the front wall of the pack 1 and after the incision 9 has been made they are driven away from the pack 1. FIG. 3 shows a situation where the incision 9 has already been made both on the upper front wall, and on the lower front wall, not to be seen in the drawing, and the knives 5, 5' have been driven away from the pack 1. The opening elements 6 have been translated by means of the actuator 8 so that their blades 10 have been slid under the deflected surface 11 of the front wall through the gap 15 formed by the incision 9. FIG. 5 shows the arrangement of the opening elements 6 before they have been driven towards the pack 1. FIG. 6 shows an alternative embodiment of the elements 6' consisting of rotary knives. Before introducing the blades 10' into the gaps 15', the opening elements 6' are rotated so that they abut to the front wall of the pack in front of the gap 15'. Both embodiments of the element 6, 6' are provided with beveled edges 14, 14' facilitating the movement of the blade 10, 10' relative to and into the inside of the pack. Moving the elements 6, 6' by means of the actuator 8 towards the pack 1 causes sliding the blades 10, 10' under the deflected surface 11 of the wall, while moving the elements 6, 6' further inside the pack 1 causes its opening. In order to open the pack 1 the relative movement of the pack 1 and the opening element 6, 6' is necessary. In both cases the cutting blade 12 is driven adjacent to the deflected surface 11 of the wall and starts to cut it, and in the next step the cutting blade 10, 10' reaches the edge connecting the front wall with the bottom of the pack 1. Then in the next phase of the opening the connection of the front wall with the bottom is torn. The cutting of the front wall by the blade 1 of the opening elements 6, 6' and the tearing of the connection of the front wall with the bottom results in the opening of the pack 1. Using two opening elements 6 on the two sides of the pack may cause a total disruption of the pack. The contact surface 13, 13' of the element 6, 6' supports the cigarettes inside the pack 1 so that a bundle of cigarettes in the pack 1 is not deformed during the opening of the pack. After the pack 1 has been opened, the bundle of cigarettes wrapped in an aluminum foil is removed therefrom and deformation of the bundle perpendicularly to the cigarette axes will cause the cigarettes to leave the foil.

Figure 10:
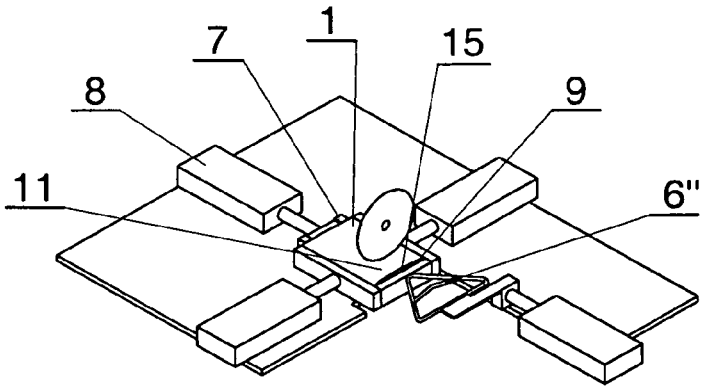
FIG. 10 shows a perspective view of the first embodiment of the apparatus with an optionally shaped opening element.

Other embodiments of the opening element are possible. The opening element may consist of two knives, each provided with at least one cutting edge, the knives being slid side by side into the gap 15. This embodiment is advantageous in the case of hard packs. The knives may move in parallel or each at a certain angle, substantially in the direction of a corner of the pack. The opening element may be provided with a tearing element 6" shown in FIG. 10 in the form of a perforated element. The lower contact surface supporting the cigarettes and the sides of the tearing element are moved above the cigarettes and destroy the wall of the pack under which they were slid.

Figure 11:
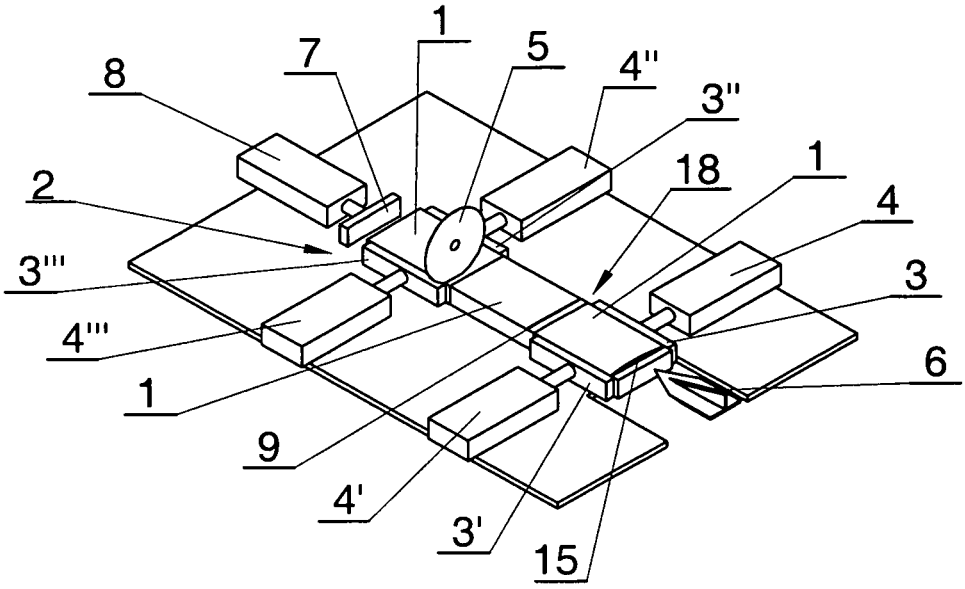
FIG. 11 shows a perspective view of the second embodiment of the apparatus according to the invention.

FIG. 11 shows the second embodiment of the apparatus according to the invention. The apparatus according to this embodiment enables continuous opening of the packs. The apparatus comprises a seat 2 in which the pack 1 is located to be opened. On both sides of the pack 1 holding elements 3", 3'" are located that are designed to catch the pack 1 and to hold it in swollen condition during incision and opening. The holding elements 3", 3'" are moved by means of actuators 4", 4'" and are adapted to be moved in perpendicular to the side walls of the pack 1 located in the seat 2. The holding elements 3", 3'" may also be rotated, being driven by means of rotary actuators about an axis parallel to the side walls of the pack 1. In both cases electric drive e.g. electromagnet drive may be used. In FIG. 11 the holding elements 3", 3'" are shown in a position adjacent to the pack 1. The incision of the pack 1 may be performed by means of e.g. rotating knife 5 which are driven adjacent to the pack 1 and then sunk into the pack to such a cutting depth. In FIG. 11 the knife 5 is shown in a position sunk into the pack 1. The knife 5 may be moved in a direction substantially perpendicular to the incised surface and after it has been sunk into this surface it performs the incision 9 by being translated in parallel to the incised surface and in perpendicular to the axes of rotation of the knife 5. The guides necessary for the linear movements of the knife 5 and the rotary drive have been omitted in the drawing for the sake of simplicity. The knife 5 is arranged in such a way that the incision 9 is made at the distance of 5-10 mm from the edge connecting the bottom of the pack 1 with its front wall.

The apparatus for opening of packs 1 is provided with an opening element 6 located on the side of the pack where the incision is made. On the other side of the pack a pusher 7 is arranged, which is designed to perform translation movement in order to move successive packs to the seat 18, where the opening of the packs is performed. The pusher 7, driven by the actuator 8, is aimed at translating the pack 1 towards the opening element 6. In order to deform the pack 1 which is necessary to convert the incision 9 into a gap 15 receiving the opening element 6, elements 3", 3'", driven by the actuators 4", 4'" are provided. The opening element 6 may consist of e.g. a non-planar knife. The apparatus for opening the packs 1 shown in FIG. 11 is equipped with one stationary opening element 6, the structure of which was described in relation to the first embodiment.

The pack 1 from which the cigarettes are to be removed is inserted from above in the seat 2 (FIG. 11). Then the activated actuators 4", 4'" move the holding elements 3", 3'" towards the pack 1 into a position enabling it to be caught and deformed. After the pack 1 has been swollen, the rotating knife 5 is driven towards the front wall of the pack 1. Driving the knife 5 adjacent to the front wall and its sinking into this wall causes the process of incision to start. Then the knife moves in the direction parallel to the front wall of the pack 1 and after the incision 9 has been made it is driven away from the pack 1. The driving the knife 5 adjacent to the front wall, performing the incision 9 as well as the driving the knife away is performed while the knife is situated substantially perpendicularly to the surface of the front wall of the pack 1 in which the incision 9 is made. FIG. 11 shows the knife 5 during making the incision 9 in the front wall of the pack 1. After the incision 9 has been made the holding elements 3", 3'" are moved away to a location away from the pack 1. The pusher 7, driven by the actuator 8, translates the pack 1 with the incision towards the seat 18, the stroke of the pusher 7 corresponding to the length of the pack 1. A next pack 1 is placed in the seat 2, the holding elements 3", 3'" catch the pack 1 and an incision 9 is made on the front wall. Upon delivery of a still next pack and after activating the pusher 7 by the stroke corresponding to the length of the pack, the first pack delivered is located in the seat 18. After the actuators 4", 4'" have been activated, the holding elements 3", 3'" are driven adjacent to the pack 1 located in the seat 18 which causes swelling of the pack. The opening element 6 located in front of the bottom of the pack 1 has a blade 10 situated at the level suitable for it to be slid under the deflected surface 11 of the front wall through the gap 15 formed by the incision 9. After the incision 9 has been made on the front wall of the pack 1 in the seat 2 and the holding elements 3", 3'" have been moved away, the pusher 7, driven by the actuator 8, translates all the three packs 1 located in the apparatus towards the opening element 6. The movement of the pack 1 located in the seat 18 caused by the movement of the pusher 7 results in sliding the blade 10 of the opening element 6 through the gap 15 under the deflected surface 11 of the front wall. Then the process of opening the pack continues as described above in the first embodiment of the apparatus.

Figure 12:
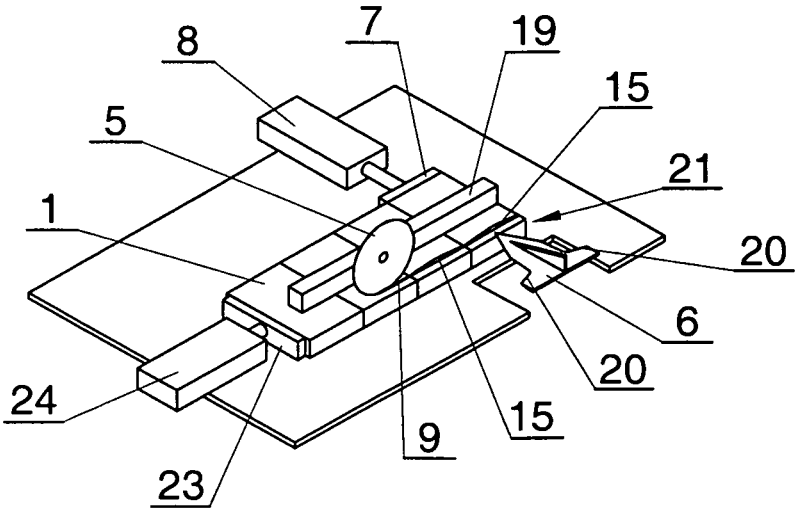
FIG. 12 shows a perspective view of the third embodiment of the apparatus according to the invention.

FIG. 12 shows the third embodiment of the apparatus in which means 19 have been foreseen for deforming the pack 1 by negative pressure. The means 16 are situated in such a way, that the packs 1 are able to be moved under the means 19 so that the front walls of the packs contact the lower side of the means 19 constituting their sucking means. The lower side of the means 19 interacts with the front wall of the packs and deflects them towards the outside of the packs. The rotary knife 5 for incising the front wall is situated so that its plane is parallel to the direction of movement of the packs 1. The apparatus is equipped with an actuator 8 provided for moving the packs 1 by means of a pusher 7 in the direction of the opening element 6. The opening element 6 has two cutting edges 20 designed for cutting the corners of the pack 1. The opening elements described in the foregoing embodiments may also have edges for cutting the corners of the pack.

The packs 1 are moved linearly by conventional methods e.g. by a pusher 24, under the negative pressure means 19 for deforming the packs in a direction parallel to the direction of incision from the outside. The packs contact each other by their side walls. While the packs 1 are moved towards the seat 21, their upper front walls are deformed by the negative pressure provided by the means 19. The deflected upper front wall of each pack is moved under the rotating knife 5, which cuts this wall making the incision 9. Thanks to the continuous provision of the negative pressure, the incision 9 is widened and the gap 15 is formed through which the opening element 6 is slid inside the pack. The pack is then located in the seat 21 while the previously made gap remains formed. After the actuator 8 has been activated the pusher 7 moves the pack 1 so that the blade of the opening element 6 is slid through the gap 15 into the inside of the pack. The destructive opening of the pack 1 is realized as in the above described embodiments, the edges 20 of the opening element 6 cutting the corners of the pack 1 in the last stage of the opening.

The above described methods of deforming the pack do not limit all the technical possibilities of achieving the result of deflecting one of the pack walls; just the simplest ways have been shown by which the wall is separated from the cigarettes contained in the pack.

The invention claimed is:

1. An apparatus for destructive opening cigarette packs comprising means for moving the packs in the apparatus, means for deforming successive packs by deflection of at least one wall of each pack toward the outside of the pack, means for incising at least one of the walls of the pack from the outside, and at least one pack opening element for opening successive packs from the inside, the pack opening element being slideable through the outside incision between the deflected wall of the pack and the cigarettes contained therein, the pack opening element that is slid through the outside incision having a part consisting of a contact surface that is substantially parallel to the pack wall being cut, the pack opening element also comprising a blade having a beveled edge for breaking the connection of the wall being cut with the bottom of the pack.

2. Apparatus of claim 1, wherein the element for opening the pack from the inside comprises at least one cutting blade located on its side opposite to the contact surface.

3. Apparatus of claim 1, wherein the pack opening element has cutting edges for cutting the corners of the pack.

4. Apparatus of claim 1, wherein the means for incising from the outside comprises at least one disc knife.

5. Apparatus of claim 1, wherein the apparatus is provided with means for incising from the outside both front walls of a pack, each of the walls being incised along one edge, and with two pack opening elements, each located adjacent to one of the opposing front walls of at least one pack.

6. Apparatus of claim 1, wherein the means for deforming the packs comprise holding means driven by actuators.

7. Apparatus of claim 6, wherein the holding means comprise rotary holding elements.

8. Apparatus of claim 1, wherein the at least one pack opening element is mounted in such a way that it may be translated transversely in relation to the line of the incision made from the outside.

9. Apparatus of claim 1, wherein the at least one pack opening element is mounted in such a way that it may be rotated about an axis parallel to the outside incision.

10. Apparatus of claim 1, wherein the means for moving the packs in the apparatus comprises a pusher moving the packs in the direction towards the pack opening element.

11. An apparatus for destructive opening cigarette packs comprising:

pushers for moving cigarette packs in the apparatus;

holders for deforming successive packs by deflection of at least one wall of each pack toward the outside of the pack;

at least one disc knife for incising at least one wall of the pack from outside the pack to form an outside incision;

at least one pack opening element for opening successive packs from inside the pack, the pack opening element being slideable through the outside incision between the deflected wall of the pack and cigarettes contained inside the pack, the pack opening element that is slid through the outside incision having a part consisting of a contact surface that is substantially parallel to the pack wall being cut, the pack opening element also comprising a blade having a beveled edge for breaking the connection of the wall being cut with the bottom of the pack.

* * * * *